United States Patent [19]

Nicholl et al.

[11] 4,177,500

[45] Dec. 4, 1979

[54] POWER FAILURE LIGHT AND CIRCUIT THEREFOR

[75] Inventors: Thomas H. Nicholl, 1204 W. 27 St., Kansas City, Mo. 64108; John J. Collins, Kansas City, Mo.

[73] Assignee: Thomas H. Nicholl, Kansas City, Mo.

[21] Appl. No.: 947,261

[22] Filed: Sep. 29, 1978

[51] Int. Cl.[2] ..... F21V 19/04

[52] U.S. Cl. ..... 362/20; 362/183; 362/254; 315/86

[58] Field of Search ..... 362/20, 183, 186, 226, 362/254; 315/86, 87; 340/660, 635; 200/312, 315

[56] References Cited

U.S. PATENT DOCUMENTS

| | | | |
|---|---|---|---|
| 2,863,038 | 12/1958 | Lombardo | 362/20 |
| 3,739,226 | 6/1973 | Seiter et al. | 362/20 |
| 4,001,803 | 1/1977 | Lombardo | 362/20 |
| 4,071,749 | 1/1978 | Balogh | 362/20 |

*Primary Examiner*—Benjamin R. Padgett
*Assistant Examiner*—J. L. Barr
*Attorney, Agent, or Firm*—Fishburn, Gold & Litman

[57] ABSTRACT

A power failure light for monitoring a power line and for illumination upon the interruption of power therefrom includes a light bulb, a rechargeable battery, a power supply providing charging current for the battery, a pair of diodes connecting the battery across the power supply, a pair of cascaded transistors connecting the bulb across the battery with the base-emitter junctions of the transistors connected across the diodes to thereby sense the condition of the power line. The base-emitter junctions are reversed biased by the pulsating voltage across the diodes, and a timing network, including a resistor across the power supply and a capacitor across the diodes, maintains the reverse biased condition of the junctions between the voltage pulses.

13 Claims, 4 Drawing Figures

POWER FAILURE LIGHT AND CIRCUIT THEREFOR

The present invention relates to emergency lighting and more particularly to an improved device for illumination upon the interruption of power from an electrical power line.

When a power failure occurs in a household at night, a power failure light responds to provide emergency illumination so that the occupants may move about safely in order to take measures to restore the illumination either by changing fuses, if necessary, or by finding and deploying other light sources such as candles, portable electric lanterns, or the like.

In most power failure lights, the power line voltage or current is operative to maintain a controlled switch in an open position, whereby a circuit containing a light bulb and a rechargeable battery is incomplete. Current from the power line is conducted through the battery to maintain same in a charged condition. Upon interruption of the power, the controlled switch is allowed to close, thereby conducting battery current through the light bulb, illuminating same.

One known power failure light employs a transformer in the power supply thereof and an electromechanical relay as the controlled switch. The transformer is a relatively heavy component while the relay switch contacts are subject to mechanical failure.

In another known power failure light, the controlled switch is a transistor wherein the small difference in turn-on bias and turn-off bias requires a substantially steady DC power supply and, therefore, a large electrolytic capacitor in order to prevent undesired periodic conduction through the transistor. Electrolytic capacitors have a tendency to dry out over a period of time whereby the capacitance thereof is lowered and the ripple of the supply current is increased. More importantly, there is a phenomenon associated with nickel-cadmium, or nicad, batteries known as "memory" which limits the capacity thereof for storing a charge. The memory effect is aggravated by the use of steady DC current in charging.

The principal objects of the present invention are: to provide a power failure light which monitors a power line and turns on when there is a power failure; to provide such a power failure light which includes rechargeable batteries which are constantly charged during monitoring; to provide such a power failure light which charges the batteries with high ripple DC thus preventing the so-called "memory" effect which limits the useful capacity of the batteries; to provide such a light including circuitry which is efficient whereby the duration of illumination after a power failure is maximized; to provide such a power failure light which is compact in size and light in weight; to provide such a power failure light which can be used as a rechargeable flashlight; to provide such a power failure light which does not require the use of a power transformer, a large filter capacitor, or a relay therein; to provide such a power failure light with an indicator which is illuminated during charging of the batteries and which doubles as a night light; and to provide such a power failure light which is economical to manufacture, convenient, durable, and positive in operation, and which is particularly well adapted for its intended purpose.

Other objects and advantages of this invention will become apparent from the following description taken in connection with the accompanying drawings wherein are set forth, by way of illustration and example, certain embodiments of this invention.

The drawings constitute a part of the specification, include an exemplary embodiment of the present invention, and illustrate various objects and features of the power failure light.

Figure 1:
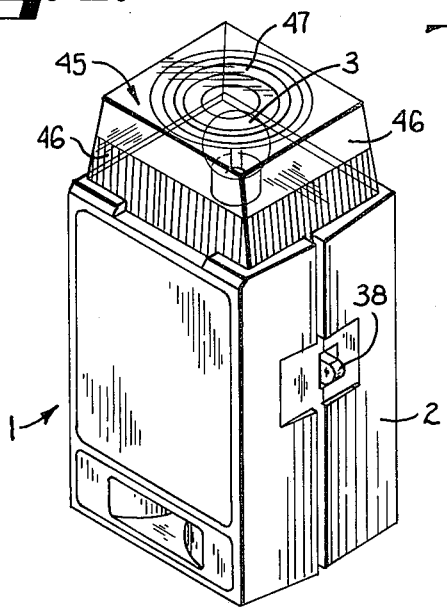
FIG. 1 is a perspective view of the power failure light of the present invention.
Figure 2:
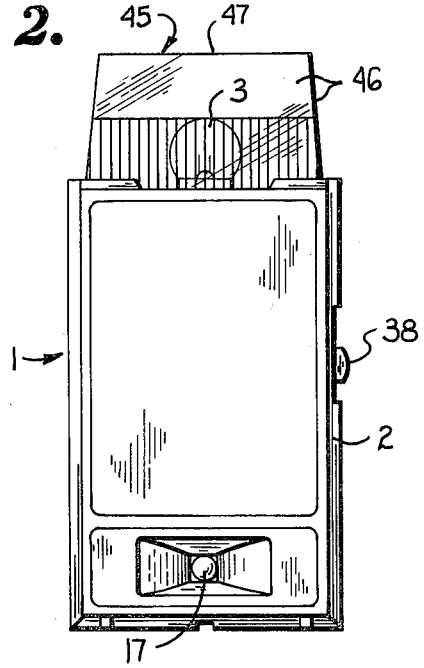
FIG. 2 is a front elevational view of the power failure light.
Figure 3:
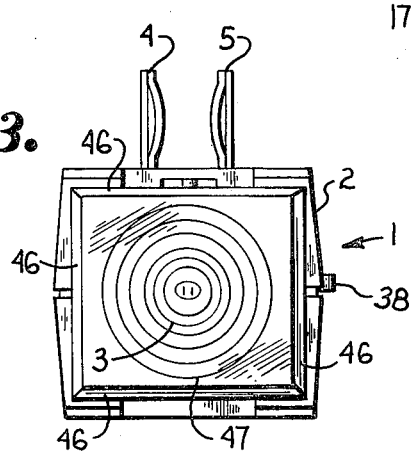
FIG. 3 is a top plan view of the power failure light.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a power failure light for providing emergency illumination in response to the interruption of electrical power from a power receptacle. The power failure light 1 includes a housing 2, a light bulb 3 mounted through the housing for external illumination, a pair of prongs 4 and 5 mounted through the housing for connection of the power failure light 1 to an AC receptacle (not shown), a rechargeable battery or batteries 6 mounted within the housing 2, and a switching circuit 7 mounted in the housing for providing charging current to the battery 6 and for completing a circuit from the battery to the light bulb 3 in response to the interruption of power from a receptacle having the power failure light 1 connected thereto.

A full wave rectifier power supply 10 provides charging current for the battery 6. Low voltage is provided by the transformerless power supply 10 by means of a series capacitor 11 which provides a reactive voltage drop. The capacitor 11 has a value of about 0.68 microfarad with a 250-volt rating. The power supply 10 includes diodes forming a full wave rectifier bridge 12. Within certain limits the power supply 10 is substantially a constant current power supply in that variation of the load impedance changes the phase angle of the current with respect to the voltage at the terminals 14 and 15 thereof but does not change the absolute value of the current.

The battery 6 is connected across the output terminals 14 and 15 of the power supply 10 by a pair of diodes 16 and 17. Preferably one of the diodes, such as diode 17 is a light emitting diode (LED) which serves as a charging/active indicator. The battery 6 is preferably a pair of nickel-cadmium, or nicad, batteries of the AA or penlight size connected in series. The series connected battery cells have an overall voltage of 2.4 to 3 volts and have a capacity for illuminating the light bulb 3 for duration of about 90 minutes when fully charged. The batteries 6 are charged with a current of about 35 milliamperes.

As mentioned above, nicad batteries have a phenomenon associated therewith called memory wherein the batteries lose their ability to be charged fully. Memory in a nicad battery can be effected in a number of ways, among them being charging the battery with steady DC. While memory is a reversible effect, restoring the capacity of the batteries generally requires discharging same to a voltage below the nominal discharge voltage and then recharging. Such deep discharging is not only inconvenient, but is also somewhat destructive since a given battery is only capable of a limited number of charge-deep discharge cycles. In the circuit 7 of the present invention the nicad batteries are charged with unfiltered pulsating DC which prevents the memory problem from arising.

The circuit 7 includes switching means operative to sense the presence of power at the prongs 4 and 5 and to complete a circuit containing the batteries 6 and bulb 3 in response to the interruption of power at the prongs. In the illustrated circuit, the switching means comprises a pair of transistors, 20 and 21 respectively. The transistor 20 is a driver transistor and includes a base 22 connected to the negative terminal 15 of the power supply 10, a collector 23 connected through the load resistor 24 to the positive side 25 of the battery, and an emitter 26. The trasistor 21 is a power transistor and includes a base 28 having the emitter 26 of the transistor 20 connected thereto, a collector 29 connected through the bulb 3 to the positive side 25 of the battery, and an emitter 30 connected to the negative side 31 of the battery.

The transistor 21 is employed as a switch to connect the bulb 3 across the battery 6 illuminating same when the transistor 21 is turned on or conducting and to prevent illumination of the bulb 3 when cut off. The particular connections of the elements of the transistors 20 and 21 given are for the NPN transistors illustrated. However, PNP transistors would also be operable in the circuit 7 and would be suitably connected with regard to polarity.

The transistors 20 and 21 are preferably silicon transistors; and in a silicon transistor, such as transistor 20, a voltage of 0.7 volts is required on the base 22 with respect to the emitter 26 in order for conduction to occur from the collector 23 to the emitter 26. In the illustrated configuration, the base-emitter junctions 22/26 and 28/30 of transistors 20 and 21 respectively, are connected in series; therefore, a voltage of 1.4-volts from the base 22 to the emitter 30 is required to turn both of the transistors on. During charging of the battery 6, current flows from the positive terminal 14 of the power supply 10 through the battery from the positive side 25 to the negative side 31 and returns through the diodes 17 and 16 to the negative side 15 of the power supply. As a result of current flow through the diodes 16 and 17, there is a voltage drop across each one.

Figure 4:
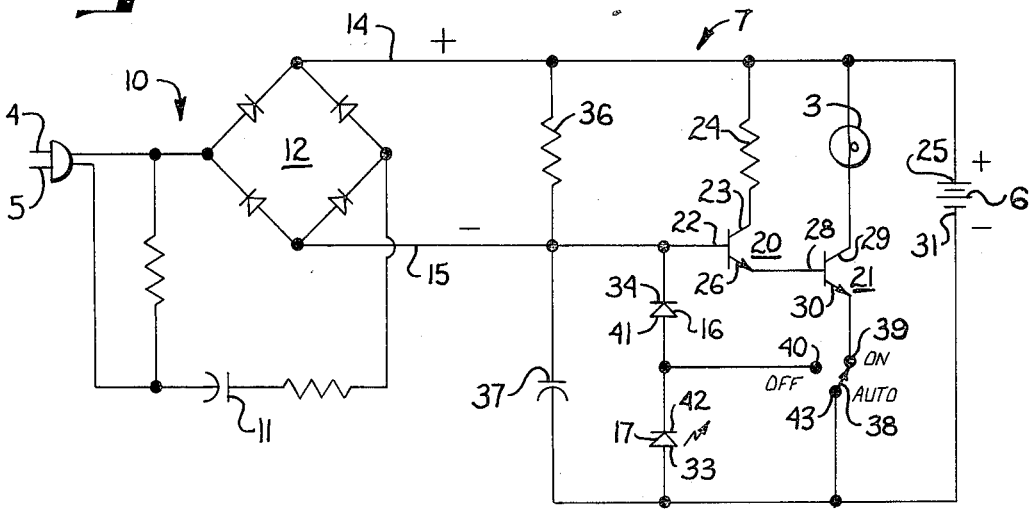
FIG. 4 is a schematic diagram of the circuitry of the power failure light.

Semiconductor diodes are inherently non-linear; that is, the voltage across a diode is not a constant function of the current therethrough or vice versa. In general, the voltage drop across a diode is substantially constant when the current therethrough exceeds a small threshold value. In the illustrated circuit, the voltage across diode 16 is 0.7, and the voltage across the LED 17 is 1.7-volts, with the total equal to 2.4-volts from the anode 33 of LED 17 to the cathode 34 of diode 16. As illustrated in FIG. 4, the series combination of the diodes is in parallel with the series combination of the base-emitter junctions of the transistors. When there is a 2.4-volt drop across the diodes 17 and 16, the junctions 22/26 and 28/30 are reversed biased and, consequently, both transistors are cut off.

In order to turn the transistors 20 and 21 on after the interruption of power at the receptacle, it is necessary to supply a suitable bias voltage to the base 22 of transistor 20. In the illustrated circuit such bias is provided by a resistor 36 connected between the positive side 25 of the battery 6 and the base 22 of transistor 20. After an interruption of power, approximately the full battery voltage is applied between the base 22 of transistor 20 and the emitter 30 of transistor 21 due to the lack of current flow through resistor 36. Transistor 20, therefore, turns on; and current flows through resistor 24, the collector 23, and the emitter 26 of transistor 20 into the base 28 of transistor 21. Transistor 21 is turned on thereby and current flows through the light bulb 3, the collector 29, and the emitter 30 of transistor 21.

As mentioned previously, current flow through the diodes 17 and 16 effects a voltage drop thereacross. However, the current flow through the diodes is not a steady, constant value. The charging current is on the order of 35 milliamps RMS which has a peak value of about 50 milliamps. The current waveform is full wave rectified sinusoidal which is a train of sinusoidal half waves varying in value from zero to 50 milliamps. The voltage drop across the diodes varies in accordance with the current wave form; however, there is some distortion due to the nonlinearity of the diodes whereby the voltage pulses are somewhat flattened and approach closely spaced square waves in shape. The voltage varies from zero to 2.4-volts at the peak. When the voltage across the diodes approaches zero, the effect of the battery 6 comes into play in biasing the base emitter junctions of the transistors 20 and 21.

In order to prevent periodic turn on of the transistors which would drain current from the battery 6 and, therefore, waste power, it is necessary to prevent the voltage across the diodes from becoming zero during the presence of power at the receptacle. For this purpose, the circuit 7 includes a timing network consisting of a capacitor 37 and the resistor 36. The capacitor 37 charges up to the peak voltage across the diodes, that is, 2.4-volts, during the peaks of the voltage pulses across the diodes. As the current through the diodes 17 and 16 approaches zero, the capacitor 37 tends to hold the voltage across the diodes at the peak value. The rate of discharge of the capacitor 37, and thereby the rate of decrease of the voltage across the diodes, is determined by the product of the values of the resistor 36 and the capacitor 37. In addition, the time constant of the resistor 36 and the capacitor 37 controls the rate at which the battery 6 is able to charge the capacitor 37 after same has discharged.

In practice, it is only necessary for the timing network of resistor 36 and capacitor 37 to prevent suitable biasing of the base-emitter junctions of transistors 20 and 21 from the end of one current pulse until the beginning of the next, which is a relatively short duration. Since the resistor 36 is connected across the power supply teminals 14 and 15, it is desirable to make the resistance thereof a fairly large value in order to limit the current flow therethrough during the presence of power. In the illustrated circuit the resistor 36 has a value of 12,000 ohms. Since the resistor 36 is fairly large, the capacitance of capacitor 37 may be relatively small and, in the illustrated circuit, has a value of 0.05 microfarad.

The values of resistor 36 and capacitor 37 given may be adjusted according to the requirements of the particular components employed in the circuit 7. The values given are able to maintain the reverse bias conditions of the base-emitter junctions of the transistors during the presence of power. Slightly smaller values of the resistor 36 and capacitor 37 would allow the junctions to become forward biased, but not great enough forward bias to turn on the transistors. Larger values of the resistor and capacitor are unnecessary and would delay illumination of the bulb 3 after the interruption of the power.

The circuit 7 has been described in terms of the two transistors 20 and 21. It would also be possible to construct the circuit 7 with a single transistor if the gain thereof were sufficient. The use of the two transistors in the preferred embodiment is a matter of economics.

It would be possible to provide the reverse or hold off bias for the transistors by the substitution of conventional, bilateral resistors. However, in the circuit illustrated, such bilateral resistors would allow current flow from the battery 6 during charging which would be wasteful of the battery power. With the diodes 16 and 17 present, current flow from the battery 6 is only possible when the transistors 20 and 21 are conducting. The LED 17, in addition to providing the reverse bias and acting as a charging/active indicator, may also be employed as a dim night light.

Preferably the circuit 7 includes a switch for selectively disconnecting the bulb 3 from the battery 6. When the power failure light 1 is removed from a receptacle for storage, use when travelling, or the like, it would not be desirable to allow the battery 6 to completely discharge through the bulb 3. Therefore, the circuit 7 includes a single pole double throw switch 38 having an ON/AUTO terminal or position 39 connected to the emitter 30 of the transistor 21 and an OFF terminal or position 40 connected between the anode 41 of the diode 16 and the cathode 42 of the LED 17. The common terminal 43 is connected to the negative side 31 of the battery 6.

In the ON position the circuit 7 is able to monitor a power line when the power failure light 1 is connected to a receptacle, or the bulb may be turned ON when the power failure light 1 is removed from the receptacle. When the power failure light is plugged into a receptacle and the switch 38 is in the OFF position, the bulb 3 will not be turned on in response to an interruption of power. However, during the presence of power the battery 6 will still be charged. In the OFF position the LED 17 is shorted and is not illuminated during charging to signal that the power failure light is not active or monitoring the power line.

The power failure light 1 may be employed as a rechargeable flashlight and, therefore, is intended to be lightweight and compact for easy portability. The power failure light 1 may be operated as a flashlight by normal operation of the switch 38. For recharging, the light 1 is plugged into a receptacle and the switch 38 is set in the OFF or ON/AUTO position.

The housing 2 is formed of high impact plastic and conveniently includes a transparent lens member 45. The lens member 45 may include frosted sides 46 for general dispersion of light and a beam forming end member 47. Alternatively, the housing may include a silvered conical or parabolic reflector member (not shown) mounted in surrounding relations to the light bulb 3 for forming a light beam therefrom.

While certain forms of the present invention have been described and illustrated, it is not to be limited thereto except insofar as such limitations are included in the following claims.

What we claim and desire to secure by Letters Patent is:

1. In a power failure light including power supply means providing pulsating DC current during reception thereby of electrical power from a power receptacle having said power failure light connected thereto; a rechargeable battery; a light bulb for illumination by said battery upon interruption of said electrical power; and circuit means including diode means connecting said battery across said power supply means whereby said battery receives charging current therefrom and transistor means connecting said light bulb across said battery and effecting conduction of current from said battery through said bulb, illuminating same, upon said interruption of said power, said transistor means having a base-emitter junction, suitable forward bias of said junction effecting said illumination of said bulb; the improvement comprising:

(a) said junction being connected across said diode means, said diode means having a pulsed voltage thereacross during the occurrences of the DC pulses of said charging current, the voltage pulses appearing across said junction and biasing said transistor means into a non-conductive state thereby preventing said illumination of said bulb; and (b) timing means connected across junction and across said power supply means, said timing means maintaining the non-conductive state of said transistor means between the occurrences of said voltage pulses across said junction and providing suitable bias to said junction after said interruption of power to thereby effect said illumination of said bulb.

2. A power failure light as set forth in claim 1 wherein said timing means comprises:

(a) a resistor connected across said power supply means; and (b) a capacitor connected across said junction.

3. A power failure light as set forth in claim 1 wherein said transistor means comprises a driver transistor and a power transistor.

4. A power failure light as set forth in claim 3 wherein:

(a) said driver transistor includes a base connected between said diode means and said power supply means, a collector operatively connected to one side of said battery, and an emitter; and (b) said power transistor includes a base connected to the emitter of said driver transistor, a collector connected through said bulb to one side of said battery, and an emitter connected between said battery and said diode means.

5. A power failure light as set forth in claim 1 wherein said junction is connected across said diode means in such a manner that said voltage pulses reverse bias said junction thereby preventing the illumination of said bulb during the occurrences of said voltage pulses.

6. A power failure light as set forth in claim 5 wherein said timing means maintains a reverse biased state of said junction between the occurrences of said voltage pulses.

7. A power failure light as set forth in claim 6 wherein said timing means includes a capacitor connected across said junction, said capacitor being sized to maintain said reverse biased state of said junction between the occurrences of said voltage pulses.

8. A power failure light as set forth in claim 7 wherein said capacitor has the smallest value thereof which will maintain said reverse biased state of said junction between the occurrences of said voltage pulses.

9. A power failure light comprising:

(a) a housing;

(b) a light bulb mounted on said housing for external illumination;

(c) a rechargeable battery mounted in said housing;

(d) plug means mounted on said housing for connection to an electrical power receptacle; and (e) circuit means interconnecting said bulb, battery and plug means for providing charging current to said battery and effecting illumination of said light bulb by current from said battery upon interruption of power from said receptacle, said circuit means comprising:

(1) power supply means providing pulsating DC current;

(2) diode means connecting said battery across said power supply means;

(3) transistor means connecting said light bulb across said battery, said transistor means having a base-emitter junction, suitable forward bias of said junction effecting said illumination of said bulb;

(4) said junction being connected across said diode means, said diode means having a pulsed voltage thereacross during the occurrences of the DC pulses of said charging current, the voltage pulses appearing across said junction and biasing said transistor means into a non-conductive state thereby preventing said illumination of said bulb; and (5) timing means including a resistor connected across said power supply means and a capacitor connected across said junction, said timing means maintaining the non-conductive state of said transistor means between the occurrences of said voltage pulses across said junction, and said resistor providing said suitable bias to said junction after said interruption of power to thereby effect said illumination of said bulb.

10. A power failure light as set forth in claim 9 wherein said voltage pulses reverse bias said junction thereby preventing the illumination of said bulb during the occurrences of said voltage pulses.

11. A power failure light as set forth in claim 10 wherein said capacitor is the smallest value which will maintain a reverse biased state of said junction between the occurrences of said voltage pulses.

12. A power failure light as set forth in claim 9 wherein:

(a) said diode means includes a light emitting diode; and (b) said light emitting diode is mounted for external illumination and serves as a charging indicator and night light.

13. A power failure light as set forth in claim 12 including a switch having:

(a) an ON position connecting said transistor means to said battery; and (b) an OFF position disconnecting said transistor means from said battery and shorting said light emitting diode.

* * * * *